US010717101B2

(12) United States Patent
Henson et al.

(10) Patent No.: US 10,717,101 B2
(45) Date of Patent: Jul. 21, 2020

(54) METHOD FOR MAKING COOLING ASSEMBLY FOR A TURBOMACHINE PART

(71) Applicant: General Electric Company, Schenectady, NY (US)

(72) Inventors: Tyler Christopher Henson, Greenville, SC (US); Jacob John Kittleson, Greenville, SC (US); Lauren Alexandra Schuhle, Greenville, SC (US)

(73) Assignee: General Electric Company, Schenectady, NY (US)

( * ) Notice: Subject to any disclaimer, the term of this patent is extended or adjusted under 35 U.S.C. 154(b) by 351 days.

(21) Appl. No.: 15/898,285

(22) Filed: Feb. 16, 2018

(65) Prior Publication Data

US 2019/0255550 A1 Aug. 22, 2019

(51) Int. Cl.

| | |
|---|---|
| ***B05D 1/32*** | (2006.01) |
| ***B05B 12/26*** | (2018.01) |
| ***F01D 5/18*** | (2006.01) |
| ***F01D 5/28*** | (2006.01) |

(52) U.S. Cl.

CPC ..... *B05B 12/26* (2018.02); *B05D 1/32* (2013.01); *F01D 5/186* (2013.01); *F01D 5/288* (2013.01); *F05D 2230/10* (2013.01); *F05D 2230/11* (2013.01); *F05D 2230/237* (2013.01); *F05D 2230/24* (2013.01); *F05D 2230/90* (2013.01); *F05D 2260/202* (2013.01)

(58) Field of Classification Search

CPC ..... B05B 12/26; B05D 1/32; F01D 5/186; F01D 5/288

USPC ..... 427/256, 282

See application file for complete search history.

(56) References Cited

U.S. PATENT DOCUMENTS

| | | | | |
|---|---|---|---|---|
| 4,743,462 | A | 5/1988 | Radzavich et al. | |
| 5,039,562 | A * | 8/1991 | Liang | F01D 5/186 415/115 |
| 7,658,590 | B1 | 2/2010 | Spanks | |
| 8,052,378 | B2 | 11/2011 | Draper | |
| 9,181,809 | B2 | 11/2015 | Roberts, Jr. et al. | |

(Continued)

FOREIGN PATENT DOCUMENTS

| | | | |
|---|---|---|---|
| CN | 110159356 | A | 8/2019 |
| EP | 2815076 | B1 | 6/2017 |

*Primary Examiner* — Nathan H Empie

(74) *Attorney, Agent, or Firm* — James Pemrick; Hoffman Warnick LLC

(57) ABSTRACT

A method of forming a cooling assembly in a turbomachine part is provided. The method includes placing an encapsulated diffuser insert partially into a hole in the turbomachine part. The encapsulated diffuser insert has an unobstructed central passageway with a generally circular cross-section at a first end and an elongated rectangular cross-section at a second end opposing the first end. The second end has a sacrificial cap. A coating step coats the turbomachine part to at least partially encapsulate the encapsulated diffuser insert in a coating. A removing step removes the sacrificial cap to enable air flow through the central passageway. The encapsulated diffuser insert remains in the hole of the turbomachine part and the coating, thereby providing the unobstructed central passageway with a generally circular first end and an elongated rectangular second end adjacent to an outer surface of the turbomachine part.

20 Claims, 8 Drawing Sheets

(56) References Cited

U.S. PATENT DOCUMENTS

| | | | | |
|---|---|---|---|---|
| 9,206,983 | B2 | 12/2015 | Merrill et al. | |
| 2004/0048003 | A1* | 3/2004 | Jeutter | B05D 1/32 427/555 |
| 2005/0286998 | A1* | 12/2005 | Lee | B23K 26/384 415/117 |
| 2007/0036942 | A1* | 2/2007 | Steele | F01D 25/12 428/131 |
| 2010/0239412 | A1* | 9/2010 | Draper | F01D 5/186 415/115 |
| 2012/0052200 | A1* | 3/2012 | Zimmerman | C23C 4/02 427/248.1 |
| 2013/0206739 | A1* | 8/2013 | Reed | B23P 15/04 219/121.71 |
| 2014/0150455 | A1* | 6/2014 | Roberts, Jr. | F01D 25/12 60/806 |
| 2015/0159254 | A1* | 6/2015 | Reid | C23C 4/18 428/137 |
| 2016/0090843 | A1* | 3/2016 | Albert | F01D 25/12 60/752 |
| 2017/0297054 | A1* | 10/2017 | Torigoe | C23C 4/02 |
| 2018/0051567 | A1* | 2/2018 | Bunker | F01D 5/186 |

* cited by examiner

METHOD FOR MAKING COOLING ASSEMBLY FOR A TURBOMACHINE PART

FIELD OF THE INVENTION

The subject matter described herein relates to a method for making cooling assemblies, and more particularly to a method where a diffusing cooling assembly is encapsulated in a thermal barrier coating of a turbomachine part.

BACKGROUND OF THE INVENTION

A turbine is subjected to increased heat loads when an engine is operating. To protect the turbine components from damage, cooling fluid may be directed in and/or onto the turbine components. Component temperature can then be managed through a combination of impingement onto the component, cooling flow through passages in the component, and film cooling with the goal of balancing component life and turbine efficiency. Improved efficiency can be achieved through increasing the firing temperature, reducing the cooling flow, or a combination.

One issue with cooling known turbine components is inadequate coolant coverage on the surface thereof. Inadequate coolant coverage may cause the average and/or local turbine component surface temperatures to remain excessively high, which increases the total heat load of the turbine and may reduce part life below acceptable levels or require use of additional cooling fluid. Therefore, an improved system may provide improved cooling coverage and thereby reduce the average and/or local surface temperature of critical portions of the turbine assembly, enable more efficient operation of the engine, and/or improve the life of the turbine machinery.

BRIEF DESCRIPTION OF THE INVENTION

In one aspect, a method of forming a cooling assembly in a turbomachine part is provided. The method includes placing an encapsulated diffuser insert partially into a hole in the turbomachine part. The encapsulated diffuser insert has an unobstructed central passageway with a generally circular cross-section at a first end and an elongated rectangular cross-section at a second end opposing the first end. The second end has a sacrificial cap. A coating step coats the turbomachine part to at least partially encapsulate the encapsulated diffuser insert in a coating. A removing step removes the sacrificial cap to enable air flow through the central passageway. The encapsulated diffuser insert remains in the hole of the turbomachine part and the coating, thereby providing the unobstructed central passageway with a generally circular first end and an elongated rectangular second end adjacent to an outer surface of the turbomachine part.

In another aspect, a method of forming a cooling assembly in a turbomachine part is provided. The method includes placing an encapsulated diffuser insert partially into a hole in the turbomachine part. The encapsulated diffuser insert has an unobstructed central passageway with a generally circular cross-section at a first end and an elongated rectangular cross-section at a second end opposing the first end. The second end has a sacrificial cap. A coating step is used for coating the turbomachine part with a thermal barrier coating to at least partially encapsulate the encapsulated diffuser insert in the thermal barrier coating. A removing step removes the sacrificial cap to open and enable air flow through the central passageway. The encapsulated diffuser insert remains in the hole of the turbomachine part and the coating, thereby providing the unobstructed central passageway with a generally circular first end and an elongated rectangular second end adjacent to an outer surface of the turbomachine part. The turbomachine part is a blade, vane or nozzle.

In yet another aspect, a method of forming a cooling assembly in a turbomachine part is provided. The method includes a placing step for placing an encapsulated diffuser insert partially into a hole in the turbomachine part. The encapsulated diffuser insert has an unobstructed central passageway with a generally circular cross-section at a first end, and an elongated rectangular cross-section at a second end opposing the first end. The second end has a sacrificial cap. The sacrificial cap has a cap conduit that is formed in a curved path, or a path with one or more inflection points. A securing step secures the encapsulated diffuser insert in the hole by at least one of, a friction fit, welding, adhesive or mechanically locking. A coating step coats the turbomachine part with a protective coating to at least partially encapsulate the encapsulated diffuser insert in the protective coating. A removing step removes the sacrificial cap to enable air flow through the central passageway. The encapsulated diffuser insert remains in the hole of the turbomachine part and the protective coating, thereby providing the unobstructed central passageway with a generally circular first end and an elongated rectangular second end adjacent to an outer surface of the turbomachine part.

BRIEF DESCRIPTION OF THE DRAWINGS

The present inventive subject matter will be better understood from reading the following description of non-limiting aspects/embodiments, with reference to the attached drawings, wherein below.

DETAILED DESCRIPTION OF THE INVENTION

Figure 1:
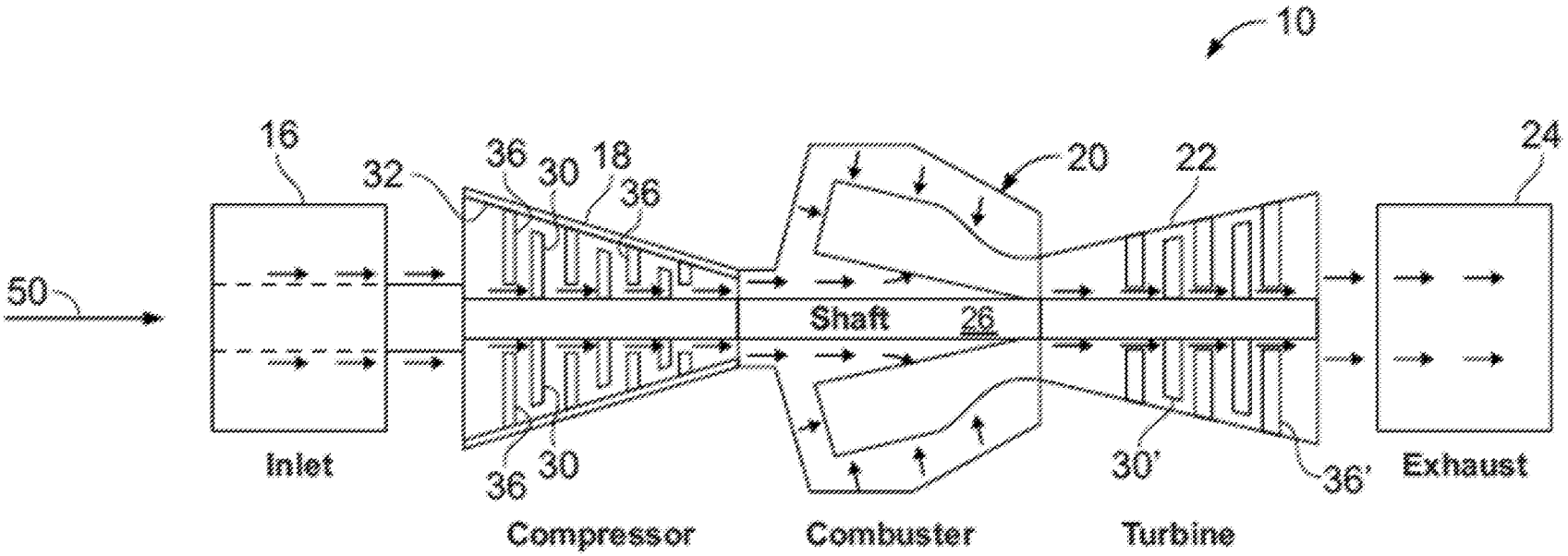
FIG. 1 illustrates a turbine assembly in accordance with one aspect.

FIG. 1 illustrates a known turbine or turbomachine 10. The turbine 10 includes an inlet 16 through which air enters the turbine 10 in the direction of arrow 50. The air travels in the direction 50 from the inlet 16, through the compressor 18, through a combustor 20, and through a turbine 22 to an exhaust 24. A rotating shaft 26 runs through and is coupled with one or more rotating components of the turbine 10 and possibly to a load (not shown) such as a generator.

The compressor 18 and the turbine 22 comprise multiple blades and vanes/nozzles. The blades 30 are located in the compressor, and blades 30' are located in the turbine. Vanes/nozzles 36 are located in the compressor, and vanes/nozzles 36' are located in the turbine. The blades 30, 30' are axially offset from the vanes 36, 36' in the direction 50 (or along an axial direction with respect to turbine 10). For example, an axial direction is collinear with the longitudinal centerline of shaft 26. The vanes 36, 36' are stationary components, whereas the blades 30, 30' are operably coupled to and rotate with the shaft 26.

Figure 2:
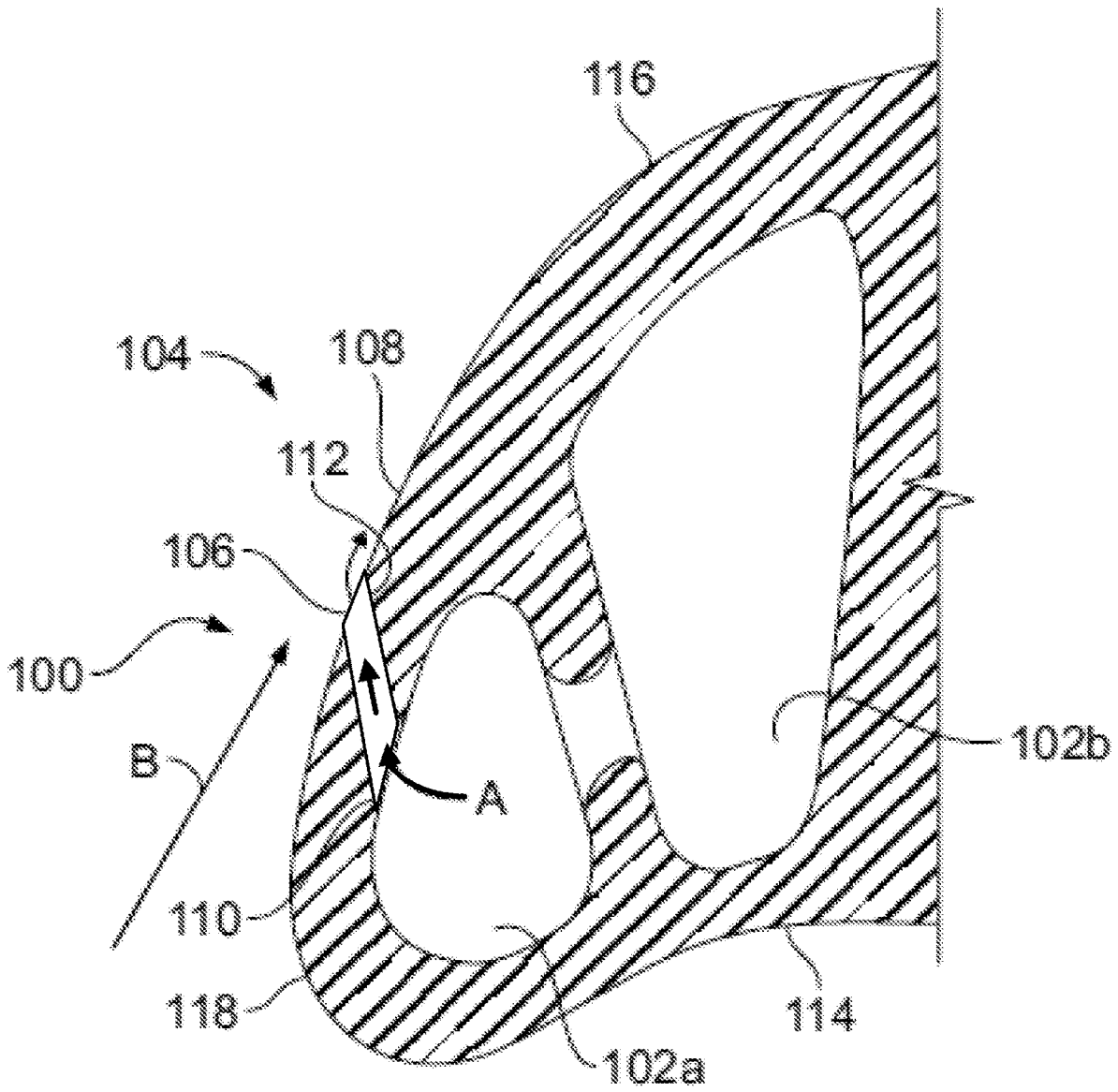
FIG. 2 illustrates a cross-sectional view of a known cooling assembly.

FIG. 2 illustrates a cross-sectional view of a known cooling assembly 100 of the turbine assembly 10 (of FIG. 1). The cooling assembly 100 operates to help cool an airfoil 104 of the turbine assembly. The airfoil 104 is a turbine blade (e.g., blades 30, 30' of FIG. 1), used in the turbine assembly 10 (of FIG. 1). The airfoil 104 has a pressure side 114 and a suction side 116 that is opposite the pressure side 114. The pressure side 114 and the suction side 116 are interconnected by a leading edge 118 and a trailing edge (not shown) that is opposite the leading edge 118. The pressure side 114 is generally concave in shape, and the suction side 116 is generally convex in shape between the leading and trailing edges of the airfoil 104. For example, the generally concave pressure side 114 and the generally convex suction side 116 provides an aerodynamic surface over which compressed working fluid flows through the turbine assembly in the direction B.

The airfoil 104 has one or more internal cooling chambers 102*a*, 102*b*. As shown, the airfoil 104 has two cooling chambers 102*a*, 102*b*. The cooling chambers 102 are disposed within the interior of the airfoil 104. For example, the cooling chambers 102 are entirely contained within the airfoil 104 between the pressure side 114 and suction side 116. The cooling chambers 102 are configured to direct cooling air inside of the airfoil 104 in order to cool the airfoil 104 when the turbine assembly is operating.

The cooling chamber 102*a* is fluidly coupled with a conduit or hole 106. As shown, one conduit 106 fluidly couples the cooling chamber 102*a* with an exterior surface 108. The conduit 106 is a cylindrical passage, having sidewall 112, that is disposed between and fluidly couples the cooling chambers 102 with the exterior of the airfoil 104. The conduit 106 directs cooling air exiting the cooling chamber 102*a* in a direction A outside of the exterior surface 108. For example, the conduit 106 directs the cooling air exiting the cooling chamber 102*a* in the direction A along the exterior surface 108 of the airfoil 104. The conduit 106 is fluidly coupled between the cooling chamber 102*a* and the exterior surface 108 on the suction side 116 of the airfoil 104. A disadvantage to the cylindrical hole/conduit 106 is that the cooling air is projected up and away from surface 108. The inlet and exit of the hole conduit 106 are generally circular in cross-section. This circular shape of the exit of the hole/conduit 106 is not very efficient in keeping the cooling air in close proximity to the surface 108 or in evenly distributing the cooling air along surface 108. Cooling air is ejected upwards out of the exit quickly and travels along a narrow path along surface 108, thereby limiting cooling air effectiveness.

Figure 3:
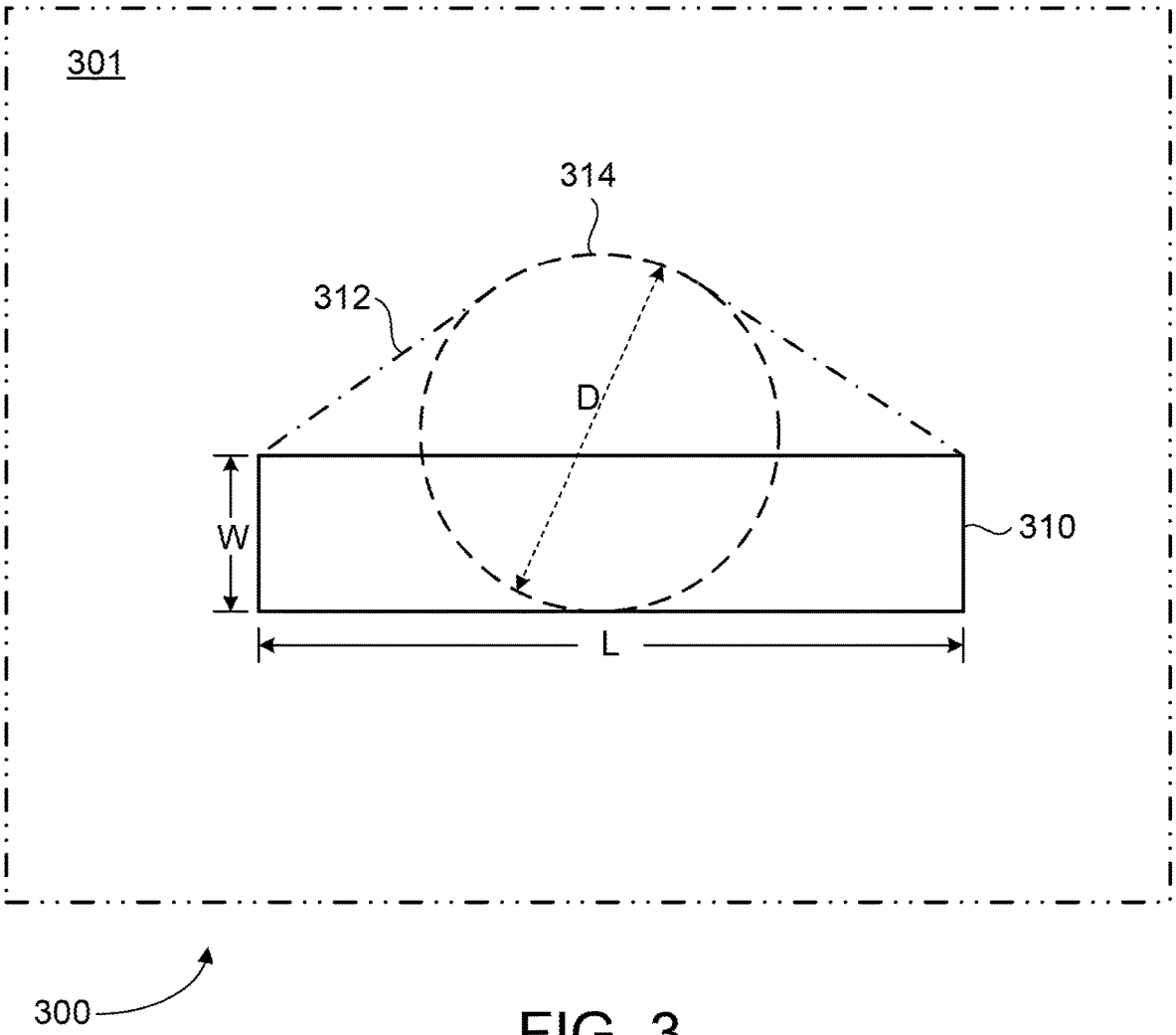
FIG. 3 illustrates a top view of an exterior surface of a turbomachine part having a cooling air exit with an elongated rectangular cross-section, according to an aspect of this disclosure.
Figure 4:
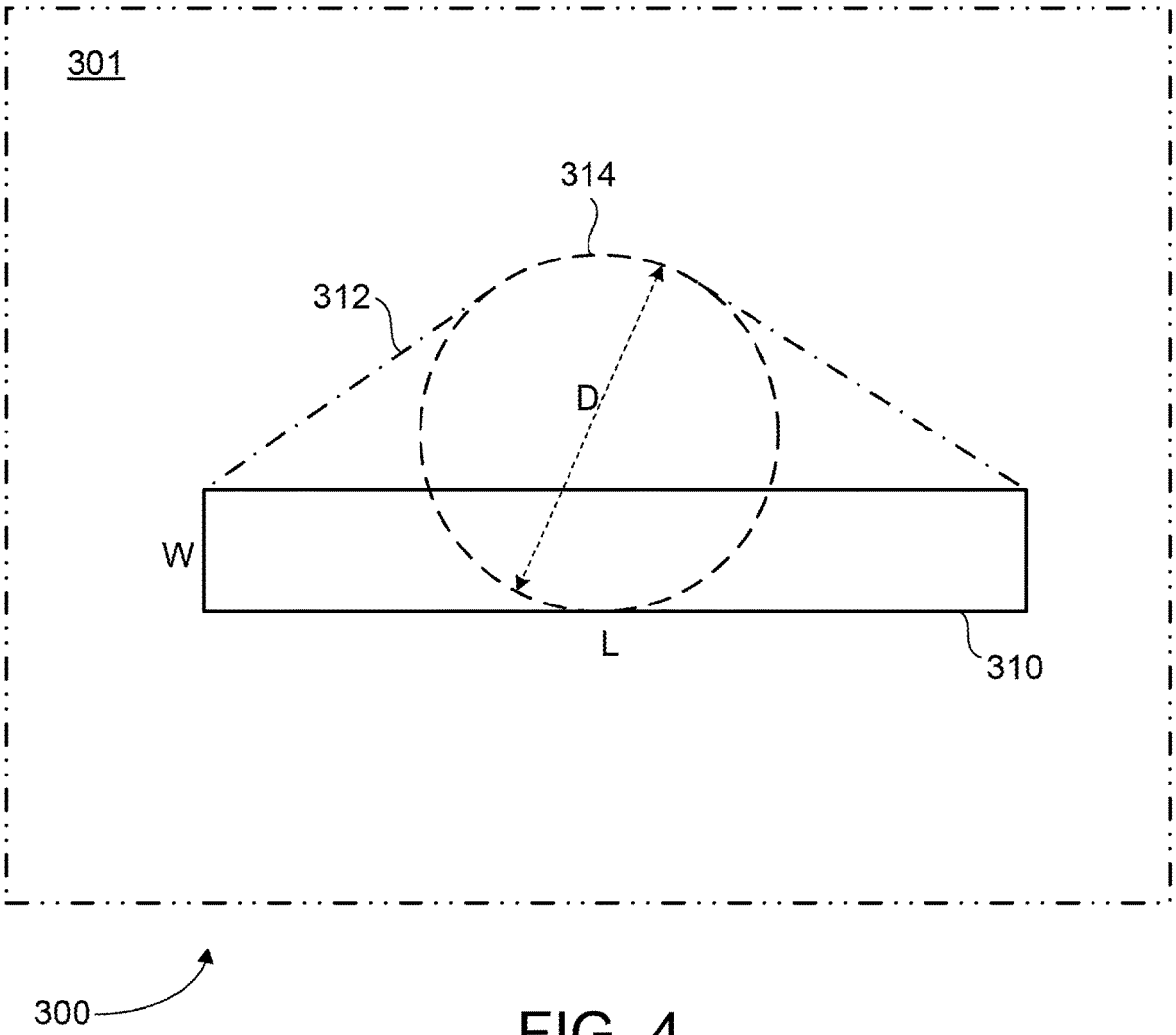
FIG. 4 illustrates a top view of an exterior surface of a turbomachine part having a cooling air exit with an elongated rectangular cross-section, according to an aspect of this disclosure.

FIG. 3 and FIG. 4 illustrate a top view of an exterior surface 301 of a turbomachine part 300, according to an aspect of this disclosure. The turbomachine part 300 may be a blade (e.g., similar to blades 30, 30' of FIG. 1), a vane/nozzle (e.g., similar to vane/nozzle 36, 36' of FIG. 1), a combustion liner or any other turbomachine part that needs to be cooled. The outer or exterior surface 301 (similar to surface 108 of FIG. 2) of the part has a rectangular (and non-square) opening (or second end) 310 that functions as the exit of an unobstructed cooling passageway 312, and a circular inlet (or first end) 314 for admitting cooling air from a cooling chamber (e.g., similar to cooling chamber 102*a* of FIG. 2) located inside part 300. The circular inlet 314 has a diameter D, and the shape of the passageway 312 transitions to a rectangular exit at opening 310 that has a width W and a length L. The opening area of the inlet 314 may be about the same as the area of the exit 310 (as shown in FIG. 3), or the area of the exit 310 may be greater than the inlet 314 (as shown in FIG. 4). As an example only, the width W is about half of the diameter D, and the length L is about one and a half times the diameter D. Alternatively, the width W of the exit 310 may be equal to or less than half the diameter D of the inlet 314, and the length L of the exit 310 may be equal to or greater than 1.5 times the diameter D of the inlet 314, as shown in FIG. 4.

Figure 5:
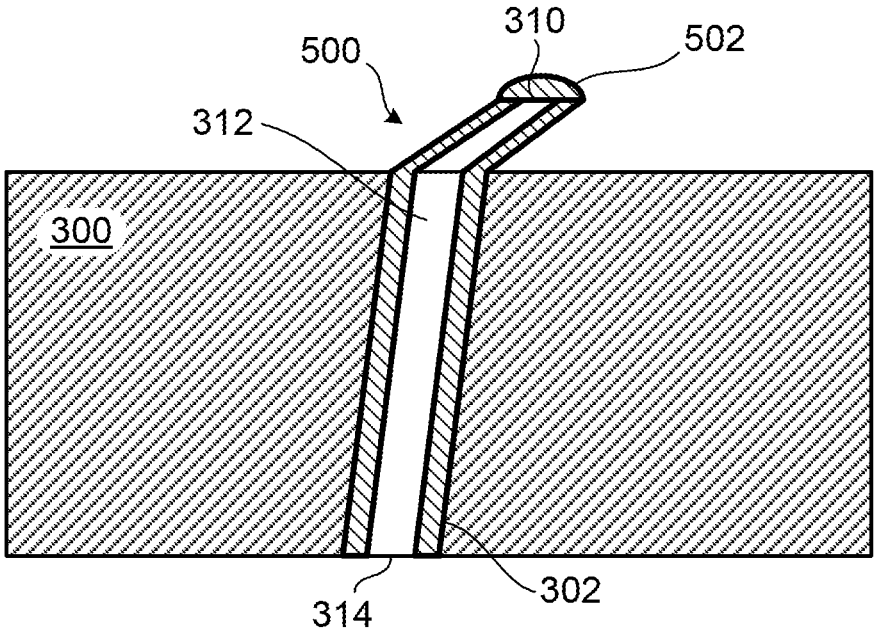
FIG. 5 illustrates a first (or placing) step in the method to form a cooling assembly, according to an aspect of this disclosure.

FIG. 5 illustrates a first step in the method to form a cooling assembly, according to an aspect of this disclosure. An encapsulated diffuser insert 500 is placed partially into hole 302 located in turbomachine part 300. The encapsulated diffuser insert 500 contains a central passageway 312 through which cooling air will flow. At an inlet (or first end) 314 of the encapsulated diffuser insert 500 the opening has a generally circular (or slightly oval) cross-section. An opposing outlet/exit 310 (or second end) has an elongated rectangular cross-sectional shape. The outlet 310 has a sacrificial cap 502 attached thereto, and the cap 502 prevents coating material from entering passageway 312.

Figure 6:
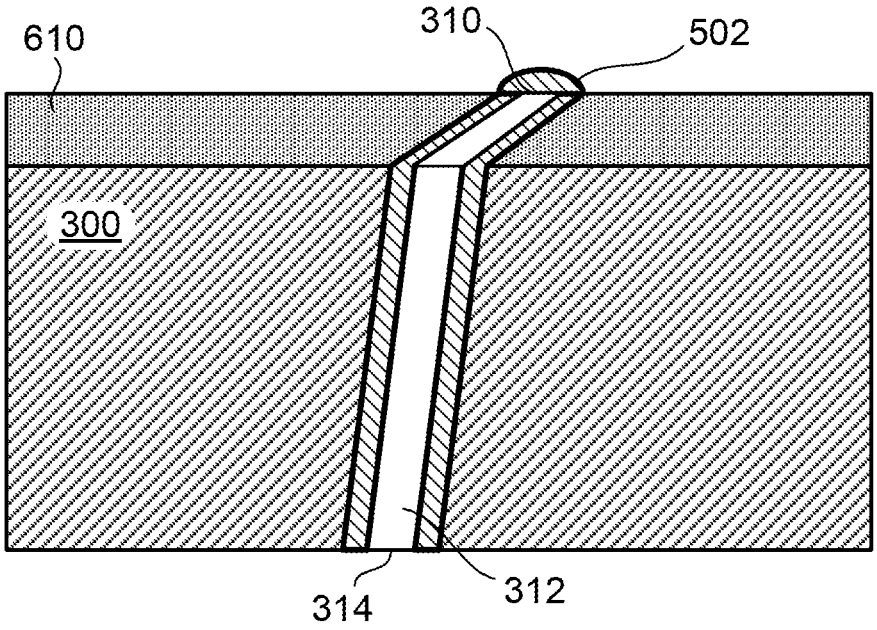
FIG. 6 illustrates a second (or coating) step in the method where a coating is applied to an outer surface of the turbomachine part, according to an aspect of this disclosure.

FIG. 6 illustrates a coating step where a coating is applied to an outer surface of the turbomachine part. The coating 610 encapsulates, at least partially, the exposed portion of the encapsulated diffuser insert 500. The sacrificial cap 502 is preferably left at least partially exposed to facilitate later identification and removal. The coating 610 may be a protective or thermal barrier coating that protects the part 300. The encapsulated diffuser insert 500 is now encapsulated by the part 300 and the coating 610.

Figure 7:
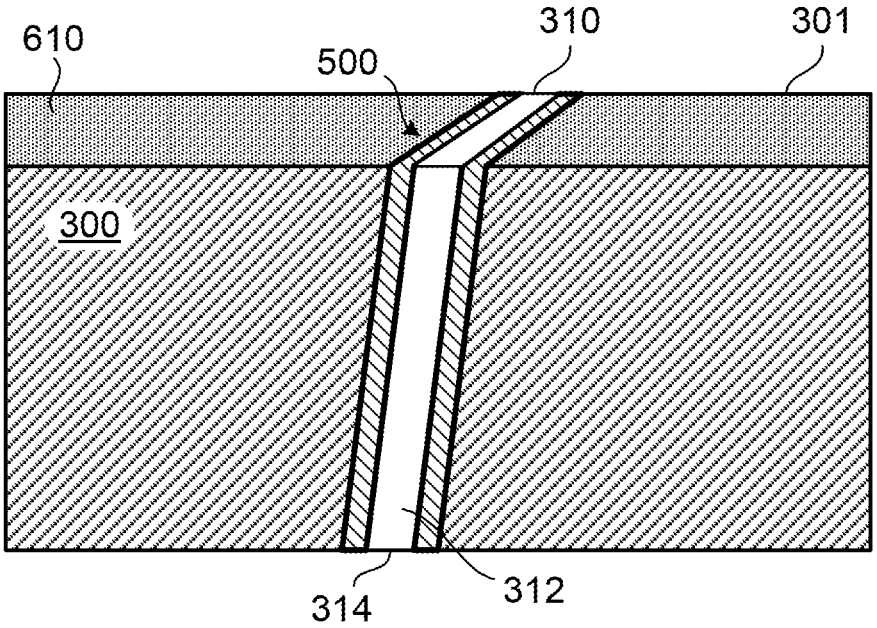
FIG. 7 illustrates a third (or removing) step where the sacrificial cap is removed, according to an aspect of this disclosure.

FIG. 7 illustrates a step where the sacrificial cap 502 is removed. The sacrificial cap 502 may be removed by grinding, machining or etching, and once the sacrificial cap 502 is removed the central passageway 312 is now completely unobstructed. Unobstructed is defined as there being no obstructions in the central passageway to impede air flow. For example, the passageway 312 is completely open to air flow. Air can flow from inlet 314 unimpeded all the way to exit 310. In contrast, a porous material may allow water or air to flow through, but the water/air flow is impeded by the non-porous regions of the material. Therefore, a porous material is not capable of permitting unobstructed air/water flow. It will be seen that the encapsulated diffuser insert 500 remains in hole 302 and defines the shape of the central cooling passageway 312, as well as the shape of the inlet 314 and exit 310. The exit 310 has an elongated rectangular shape and this shape is more efficient at distributing cooling air across the outer surface 301 of the part 300. The increased efficiency obtained will allow an increase of the turbomachine's firing temperature, which increases the turbomachine's output, while decreasing the turbomachine's heat rate. The net result is a more efficient turbomachine that is able to generate more power with less fuel, and with less wear and tear on the turbomachine parts.

The encapsulated diffuser insert 500 also permits greater options with exit hole geometry and shape. The encapsulated diffuser insert 500 may be manufactured (e.g., by brazing, additively manufacturing, extruding or machining) to have edges that are very sharp to reduce frictional losses of airflow. Turbulence of exiting airflow may also be reduced by sharp exit edges. The geometry of the exit hole may also be easily tailored for greater machine benefit. As previously described, instead of a circular exit hole, a diffusing elongated rectangular hole may be used. This elongated rectangular exit hole distributes the cooling air over a wider surface area of outer/exterior surface 301, thereby increasing cooling effectiveness and possibly reducing the number of cooling holes required. Less cooling holes translates into less cooling air, and less cooling air enables the turbomachine to use more of that air for combustion (and improved machine efficiency) purposes.

Figure 8:
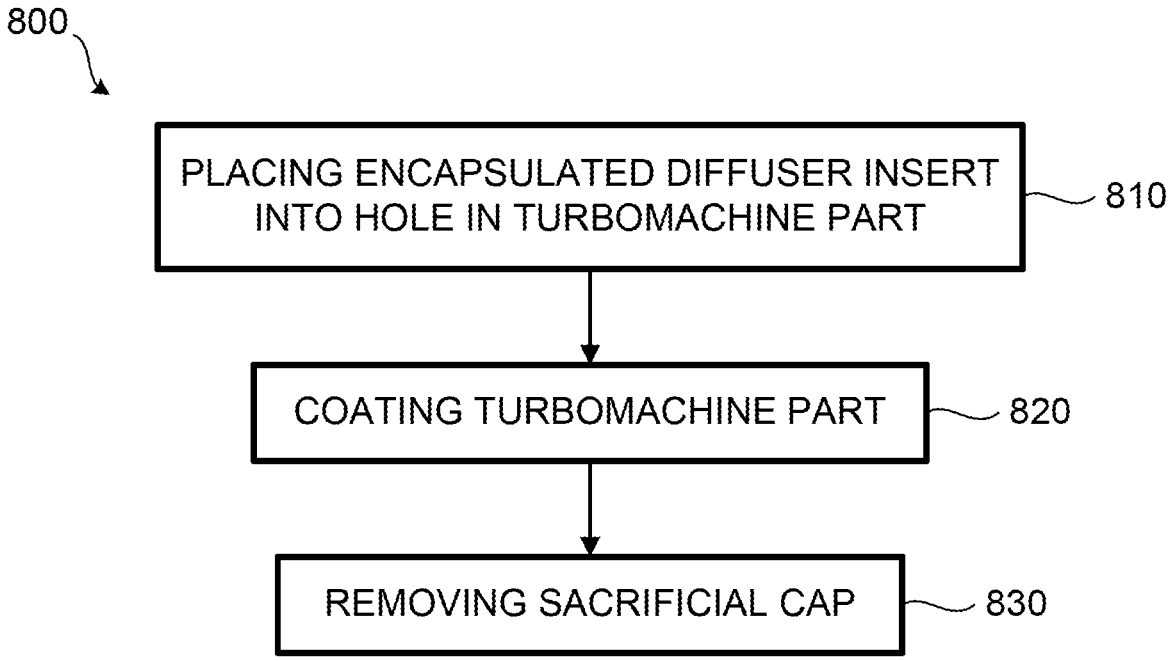
FIG. 8 is a flowchart of a method for forming a cooling assembly in a turbomachine part, according to an aspect of this disclosure.

FIG. 8 is a flowchart of a method 800 for forming a cooling assembly in a turbomachine part. The placing step 810 places an encapsulated diffuser insert 500 partially into a hole 302 in a turbomachine part 300. The encapsulated diffuser insert 500 has an unobstructed central passageway 312 with a generally circular cross-section at a first (or inlet) end 314 and an elongated rectangular cross-section at a second (or exit) end 310. The inlet end 314 opposes the exit end 310. The second (or exit) end 310 has a sacrificial cap 502 that protects the central passageway 312 from the subsequent coating step 820. A coating step 820 coats the turbomachine part 300 to at least partially encapsulate the encapsulated diffuser insert 500 in the coating 610. The coating may be a thermal barrier coating. A removing step 830 removes the sacrificial cap 502 to enable air flow through the central passageway 312. The encapsulated diffuser insert 500 remains in the hole 302 of the turbomachine part and the coating 610 thereby providing the unobstructed central passageway 312 with a generally circular first/inlet end 314 and an elongated rectangular second/exit end 310 adjacent to an outer surface 301 of the turbomachine part 300.

Figure 9:
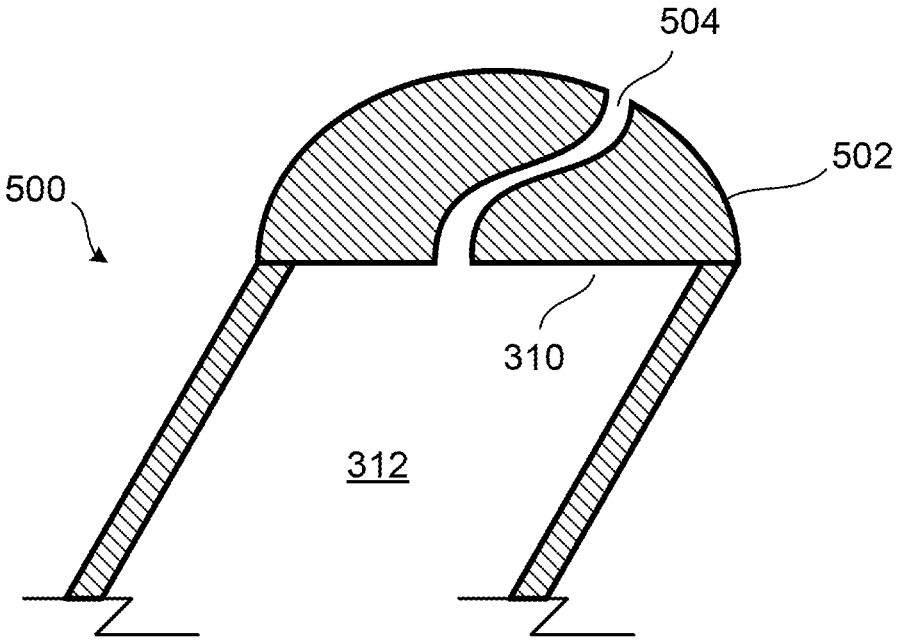
FIG. 9 illustrates a partial and enlarged cross-sectional view of the encapsulated diffuser insert where the sacrificial cap has a cap conduit that is formed in a path with one or more inflection points.
Figure 10:
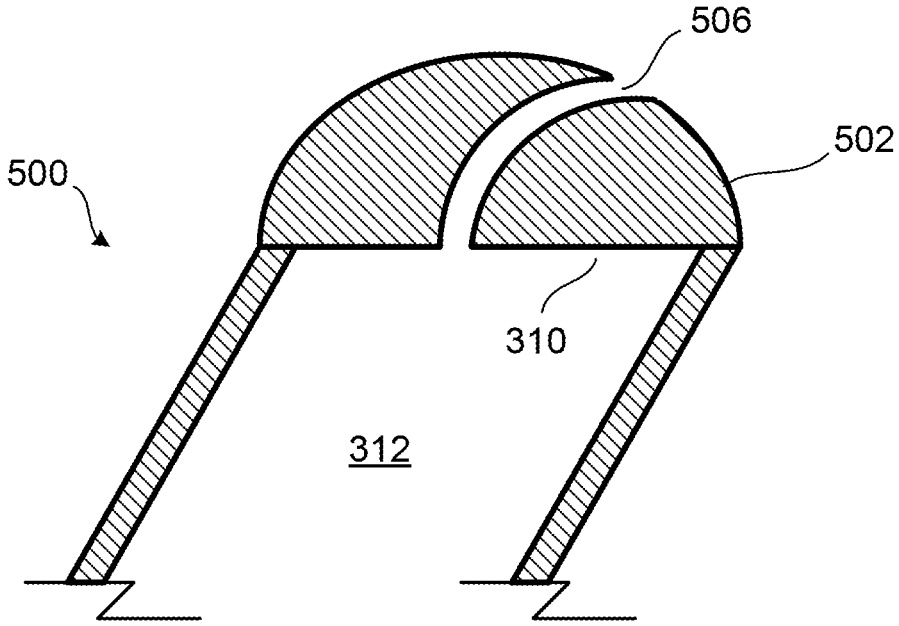
FIG. 10 illustrates a partial and enlarged cross-sectional view of the encapsulated diffuser insert where the sacrificial cap has a cap conduit that is formed in a curved path.

FIG. 9 illustrates a partial and enlarged cross-sectional view of the encapsulated diffuser insert 500 where the sacrificial cap 502 has a cap conduit 504 that is formed in a path with one or more inflection points. The cap conduit 504 provides a channel through which compressed air may be blown to remove powder from the passageway 312. In additive manufacturing, and specifically powder bed fusion type machines, powder may accumulate in the passageway 312 during manufacturing of the insert 500. The bottom 314 of the insert 500 will be open, but it can take time to get all the powder out of passageway 312 via bottom opening 314. The cap conduit 504 allows compressed air to be introduced from a top region of the sacrificial cap and this air blows the unused powder in the passageway 312 out bottom opening 314. The curved or circuitous path of the conduit 504 limits or prevents coating layer 610 from obstructing passageway 312, as the conduit 504 will plug with coating 610 before any (or any appreciable amount of) coating 610 can enter the passageway 312. For example, the very upper portion of conduit 504 may plug with coating layer 610, thereby protecting central passageway 312 from any obstructing coating material. FIG. 10 illustrates a partial and enlarged cross-sectional view of the encapsulated diffuser insert 500 where the sacrificial cap 502 has a cap conduit 506 that is formed in a curved path. Conduit 506 will function similarly to conduit 504, in that it allows for admission of compressed air during part manufacture, and plugs quickly with coating material 610 or essentially prevents coating material 610 from reaching passageway 312 and causing obstruction issues. The cap conduit may also have multiple (e.g., two or more) inflection points or be serpentine or spiral in shape.

Figure 11:
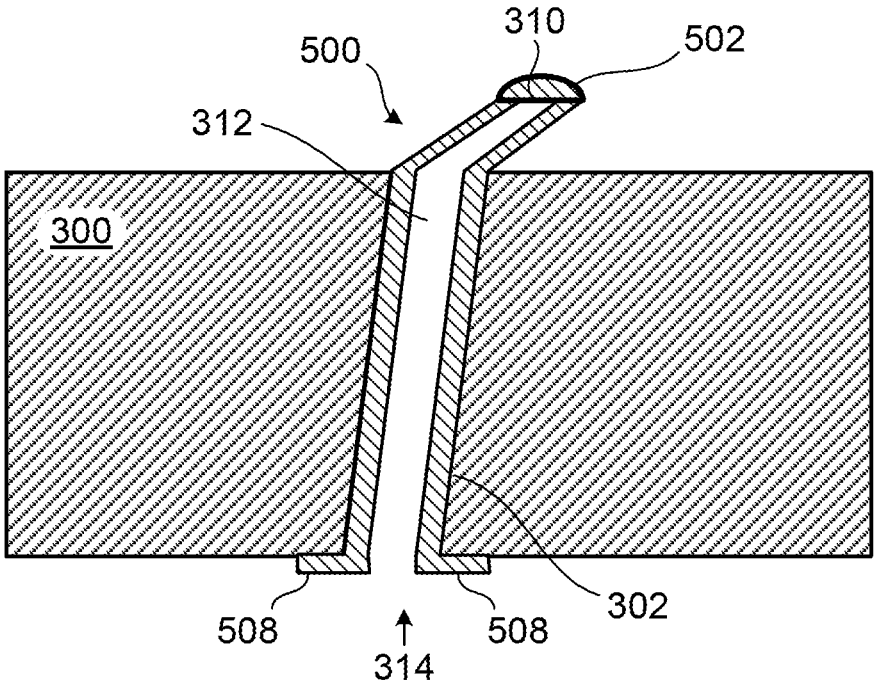
FIG. 11 illustrates a cross-sectional view of the encapsulated diffuser insert shown mechanically locked in a hole in the part.

FIG. 11 illustrates a cross-sectional view of the encapsulated diffuser insert 500 shown mechanically locked in a hole 302 in part 300. The bottom 314 of the encapsulated diffuser insert 500 may be cylindrical in shape, and this cylinder portion may be deformed to wrap around or mechanically lock to the part 300. For example, segments 508 of encapsulated diffuser insert 500 are bent (or otherwise deformed) around the bottom of hole 302, so that the encapsulated diffuser insert 500 mechanically locks to part 300. As shown, the upper, angled bend of the encapsulated diffuser insert 500 prevents the encapsulated diffuser insert 500 from going further down into hole 302, and the bottom segments 508 prevent the encapsulated diffuser insert 500 from being pulled up and out of hole 302. The bottom portion of encapsulated diffuser insert 500 can be cut to form a slit or slot therein, and the material remaining on each side of the slit/slot can be bent over against the inner surface of part 300, as shown. Alternatively, the mechanical locking could be accomplished by staking the encapsulated diffuser insert 500 to the inner surface of part 300 if access is possible.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A method of forming a cooling assembly in a turbomachine part, the method comprising:

placing an encapsulated diffuser insert partially into a hole in the turbomachine part, the encapsulated diffuser insert having an unobstructed central passageway with a generally circular cross-section at a first end and an elongated rectangular cross-section at a second end opposing the first end, the second end having a sacrificial cap;

coating the turbomachine part to at least partially encapsulate the encapsulated diffuser insert in a coating;

removing the sacrificial cap to enable air flow through the central passageway, and wherein the encapsulated diffuser insert remains in the hole of the turbomachine part and the coating, thereby providing the unobstructed central passageway with a generally circular first end and an elongated rectangular second end adjacent to an outer surface of the turbomachine part.

2. The method of claim 1, the first end having a first diameter of the generally circular cross-section and the second end having a second width and a second length of the elongated rectangular cross-section; and wherein the second width is about half the first diameter and the second length is about one and a half times the first diameter.

3. The method of claim 1, the first end having a first diameter of the generally circular cross-section and the second end having a second width and a second length of the elongated rectangular cross-section; and wherein the second width is equal to or less than half the first diameter, and the second length is equal to or greater than 1.5 times the first diameter.

4. The method of claim 1, wherein an area of the first end is about equal to an area of the second end.

5. The method of claim 1, wherein an area of the first end is not equal to an area of the second end.

6. The method of claim 1, further comprising:

prior to the placing step, forming the encapsulated diffuser insert by at least one of: brazing, additively manufacturing, extruding and machining.

7. The method of claim 1, wherein the unobstructed central passageway of the encapsulated diffuser insert is a completely unobstructed passageway with a diffusing exit.

8. The method of claim 1, the placing step further comprising:

securing the encapsulated diffuser insert in the hole by at least one of: a friction fit, welding, adhesive or mechanically locking.

9. The method of claim 1, the coating step further comprising:

coating the turbomachine part with a thermal barrier coating.

10. The method of claim 1, wherein the turbomachine part is a blade, vane or nozzle.

11. The method of claim 1, the sacrificial cap comprising a cap conduit that is formed in a curved path, or a path with one or more inflection points.

12. A method of forming a cooling assembly in a turbomachine part, the method comprising:

placing an encapsulated diffuser insert partially into a hole in the turbomachine part, the encapsulated diffuser insert having an unobstructed central passageway with a generally circular cross-section at a first end and an elongated rectangular cross-section at a second end opposing the first end, the second end having a sacrificial cap;

coating the turbomachine part with a thermal barrier coating to at least partially encapsulate the encapsulated diffuser insert in the thermal barrier coating;

removing the sacrificial cap to enable air flow through the central passageway, the encapsulated diffuser insert remains in the hole of the turbomachine part and the thermal barrier coating, thereby providing the unobstructed central passageway with a generally circular first end and an elongated rectangular second end adjacent to an outer surface of the turbomachine part, and wherein the turbomachine part is a blade, vane or nozzle.

13. The method of claim 12, the first end having a first diameter of the generally circular cross-section and the second end having a second width and a second length of the elongated rectangular cross-section:

the second width is about half the first diameter and the second length is about one and a half times the first diameter; or the second width is equal to or less than half the first diameter, and the second length is equal to or greater than 1.5 times the first diameter.

14. The method of claim 13, wherein an area of the first end is about equal to an area of the second end, or the area of the first end is not equal to the area of the second end.

15. The method of claim 12, further comprising:

prior to the placing step, forming the encapsulated diffuser insert by at least one of: brazing, additively manufacturing, extruding and machining.

16. The method of claim 12, the placing step further comprising:

securing the encapsulated diffuser insert in the hole by at least one of: a friction fit, welding, adhesive or mechanically locking.

17. The method of claim 12, the sacrificial cap comprising a cap conduit that is formed in a curved path, or a path with one or more inflection points.

18. A method of forming a cooling assembly in a turbomachine part, the method comprising:

placing an encapsulated diffuser insert partially into a hole in the turbomachine part, the encapsulated diffuser insert having an unobstructed central passageway with a generally circular cross-section at a first end and an elongated rectangular cross-section at a second end opposing the first end, the second end having a sacrificial cap, the sacrificial cap having a cap conduit that is formed in a curved path, or a path with one or more inflection points;

securing the encapsulated diffuser insert in the hole by at least one of: a friction fit, welding, adhesive or mechanically locking;

coating the turbomachine part with a protective coating to at least partially encapsulate the encapsulated diffuser insert in the protective coating;

removing the sacrificial cap to enable air flow through the central passageway, the encapsulated diffuser insert remains in the hole of the turbomachine part and the protective coating, thereby providing the unobstructed central passageway with a generally circular first end and an elongated rectangular second end adjacent to an outer surface of the turbomachine part.

19. The method of claim 18, the first end having a first diameter of the generally circular cross-section and the second end having a second width and a second length of the elongated rectangular cross-section:

the second width is about half the first diameter and the second length is about one and a half times the first diameter; or the second width is equal to or less than half the first diameter, and the second length is equal to or greater than 1.5 times the first diameter.

20. The method of claim 19, wherein an area of the first end is about equal to an area of the second end, or the area of the first end is not equal to the area of the second end.

* * * * *